US008801259B2

(12) United States Patent
Huang

(10) Patent No.: US 8,801,259 B2
(45) Date of Patent: Aug. 12, 2014

(54) LIGHT EMITTING DIODE LIGHT BAR STRUCTURE AND BACKLIGHT MODULE

(75) Inventor: Jianfa Huang, Shenzhen (CN)

(73) Assignee: Shenzhen China Star Optoelectronics Technology Co., Ltd., Shenzhen, Guangdong (TW)

( * ) Notice: Subject to any disclaimer, the term of this patent is extended or adjusted under 35 U.S.C. 154(b) by 84 days.

(21) Appl. No.: 13/522,494

(22) PCT Filed: Apr. 6, 2012

(86) PCT No.: PCT/CN2012/073573

§ 371 (c)(1), (2), (4) Date: Jul. 16, 2012

(87) PCT Pub. No.: WO2013/143160

PCT Pub. Date: Oct. 3, 2013

(65) Prior Publication Data

US 2013/0258714 A1 Oct. 3, 2013

(30) Foreign Application Priority Data

Mar. 30, 2012 (CN) ..... 2012 1 0090955

(51) Int. Cl.
*F21V 7/04* (2006.01)

(52) U.S. Cl.
USPC ..... 362/612; 362/613

(58) Field of Classification Search
USPC ..... 362/612, 613, 97.3
See application file for complete search history.

(56) References Cited

U.S. PATENT DOCUMENTS

| | | | | |
|---|---|---|---|---|
| 7,661,844 | B2 * | 2/2010 | Sekiguchi et al. | 362/249.02 |
| 2009/0168406 | A1 * | 7/2009 | Kawasaki et al. | 362/97.3 |
| 2009/0213575 | A1 * | 8/2009 | Blumel et al. | 362/97.3 |
| 2010/0103361 | A1 * | 4/2010 | Ohta et al. | 349/144 |
| 2010/0321418 | A1 * | 12/2010 | Hayashi | 345/690 |
| 2011/0267841 | A1 * | 11/2011 | Lee et al. | 362/613 |
| 2012/0140443 | A1 * | 6/2012 | Kim et al. | 362/97.1 |

* cited by examiner

*Primary Examiner* — Evan Dzierzynski

(57) ABSTRACT

The present invention discloses a light emitting diode (LED) light bar structure and a backlight module. The LED light bar structure is provided with a plurality of the light source sets. Each of the light source sets comprises a first LED and a second LED, and the chromaticity of the first LED and the chromaticity of the second LED are complementary. Hence, it is not necessary to consider with the others of the light source sets, so that it can achieve mixing a uniform white light, and the backlight module will not appear the phenomenon of "Mura". Besides, the material of the LED will not be wasted, and it is easy to control the identical chromaticity between the different backlight modules.

13 Claims, 4 Drawing Sheets

LIGHT EMITTING DIODE LIGHT BAR STRUCTURE AND BACKLIGHT MODULE

FIELD OF THE INVENTION

The present invention relates to a light emitting diode (LED) light bar structure and a backlight module, and more particularly to an LED light bar structure using a light source set of two complementary colors and a backlight module thereof.

BACKGROUND OF THE INVENTION

A liquid crystal display (LCD) is a kind of flat panel display (FPD) which displays images by the property of the liquid crystal material. In comparison with other display devices, the LCD has the advantages in lightweight, compactness, low driving voltage and low power consumption, and thus has already become the mainstream product in the whole consumer market. However, the liquid crystal material of the LCD cannot emit light by itself, and must depend upon an external light source. Thus, the LCD further has a backlight module to provide the needed light source.

Generally speaking, backlight modules have been developed based on size requirements into a type of edge lighting structures and another type of bottom lighting structures, which are categorized by locations of lamp tubes thereof. A light source of the type of edge lighting structures is a single light source placed aside, and a light source of the type of bottom lighting structures is placed right beneath. The lamp tubes of the backlight modules must be featured with high brightness and a long lifespan, etc. They currently include cold cathode fluorescent lamps (CCFL), hot cathode fluorescent lamps, light emitting diodes (LED) and electroluminescence (EL), etc.

Among them, the CCFL has characters of high luminance, high efficiency, a long lifespan, and high color rendering, etc. Besides, it is much easier to be assembled with light reflection components to form a thin-sheet lighting device due to its cylinder shape. Therefore, using the CCFL as main backlight sources was once a main trend for making backlight modules. However, the CCFL is gradually eliminated by the present trend of soaring environmental awareness today due to its filled content of mercury vapors. Since using LED as backlight sources has an advantage of energy saving and environmental protection over the CCFL, it becomes a trend in backlight development to replace the CCFL by the LED. A lighting structure of the LED is generally called as a light bar in practice.

Referring to FIG. 1, a front view showing a structure of a currently existing LED light bar is illustrated in FIG. 1. As shown in FIG. 1, an LED light bar structure 90 comprises a circuit board 91 of a substantially long strap shape and a plurality of LEDs 92. The LEDs 92 are arranged on an upper surface of the circuit board 91 and fixed thereon through a plurality of solder points (not shown) to be electrically connected with the circuit board 91. The LEDs 92 of the light bar structure 90 emit lights toward a side edge of a light guide plate (not shown), and then emit lights toward a top surface of the light guide plate by special reflection of the light guide plate, so it can be directly installed to an original location of the CCFL to replace illumination of the CCFL. Although using LEDs as the backlight source has advantages of lightness and thinness, environmental protection, electricity saving, and so on, the aforementioned existing LED light bar still has a few problems.

The white light LED is usually achieved by a means of optical mixing. For example: using a blue LED to activate a yellow fluorescent body; using an ultraviolet LED to activate a RGB (red, green, blue) fluorescent body; or using red, green and blue LEDs to achieve a white by adjust the brightness thereof, respectively. However, because of the reasons that has different manufacturing condition and are difficult to control, such the mixed LED by above-mention means has a phenomenon of chromaticity difference. When a backlight module is in design, the general method is alternate to mix the LEDs, so as to achieve a white light.

Referring to FIG. 2, a front view showing a structure of another currently existing LED light bar is illustrated in FIG. 2. As shown in FIG. 2, an LED light bar structure 80 comprises a circuit board 81 of a substantially long strap shape. A plurality of first LEDs 82 and a plurality of second LEDs 83 are alternately disposed on the circuit board 81. Each of the first LEDs 82 has the same chromaticity, and each of the second LEDs 83 also has the same chromaticity. Besides, the chromaticity of the first LEDs 82 and the chromaticity of the second LEDs 83 can mix as a white light.

However, by the traditional means to achieve a uniform mixed white color, it is necessary to confirm that the chromaticities of the selected first LEDs 82 are complete identity, and the chromaticities of the second LEDs 83 are also complete identity and accurately coordinate with the chromaticities of the first LEDs 82. Otherwise, the backlight module will appear a phenomenon of "Mura". Thus, the material selection of the LEDs is too exacting, so that it causes a waste of the material, and it is difficult to control the identical chromaticity between the different backlight modules.

As a result, it is necessary to provide an LED light bar structure to solve the problems existing in the conventional technologies.

SUMMARY OF THE INVENTION

A primary object of the present invention is to provide a light emitting diode (LED) light bar structure, so as to solve the problem existing in the conventional technologies that a white light emitting is not uniform and the chromaticities thereof is difficult to control.

To achieve the above object, the present invention provides an LED light bar structure, which comprises: a circuit board; and a plurality of the light source sets arranged on the circuit board, wherein each of the light source sets comprises a first LED and a second LED; and the chromaticity of the first LED and the chromaticity of the second LED are complementary;

wherein the first LED and the second LED are adjoined with an up-down arrangement in each of the light source sets; and a third LED is further inserted and composed between the light source sets.

To achieve the above object, the present invention further provides an LED light bar structure, which comprises: a circuit board; and a plurality of the light source sets arranged on the circuit board, wherein each of the light source sets comprises a first LED and a second LED; and the chromaticity of the first LED and the chromaticity of the second LED are complementary;

To achieve the above object, the present invention further provides a backlight module, which comprises:

a light guide plate; and an LED light bar structure disposed at a side edge of a light guide plate and emitting lights toward the light guide plate, wherein the LED light bar structure comprises:

a circuit board; and a plurality of the light source sets arranged on the circuit board, wherein each of the light source sets comprises a first LED and a second LED; and the chromaticity of the first LED and the chromaticity of the second LED are complementary.

In one embodiment of the present invention, the chromaticity of the first LED is near blue in the CIE coordinate, and the chromaticity of the second LED is near yellow in the CIE coordinate.

In one embodiment of the present invention, the chromaticity of the first LED is near yellow in the CIE coordinate, and the chromaticity of the second LED is near blue in the CIE coordinate.

In one embodiment of the present invention, the first LED and the second LED are adjoined with an up-down arrangement in each of the light source sets.

In one embodiment of the present invention, the first LED and the second LED are adjoined with a left-right arrangement in each of the light source sets.

In one embodiment of the present invention, a third LED is further inserted and composed between the light source sets, and the chromaticity of the LED is in the white light area of the CIE coordinate.

In one embodiment of the present invention, the level height of the third LED is between the first LED and the second LED.

Hence, the LED light bar structure according to the present invention is not necessary to consider with the others of the light source sets, so that it can achieve mixing a uniform white light, and the backlight module will not appear the phenomenon of "Mura". Besides, the material of the LED will not be wasted, and it is easy to control the identical chromaticity between the different backlight modules.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 1:
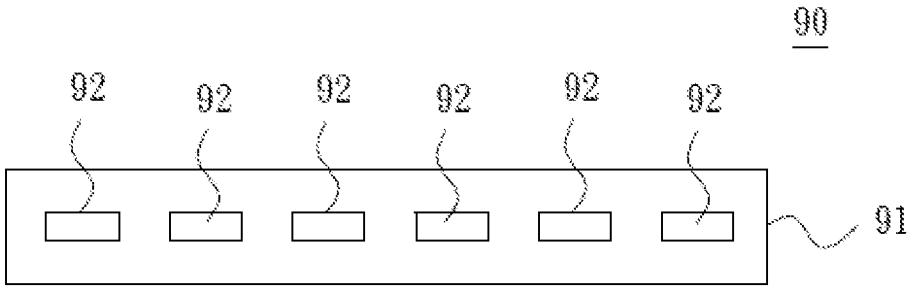
Fig. 1 Prior Art
FIG. 1 is a front view showing a structure of a currently existing LED light bar.
Figure 2:
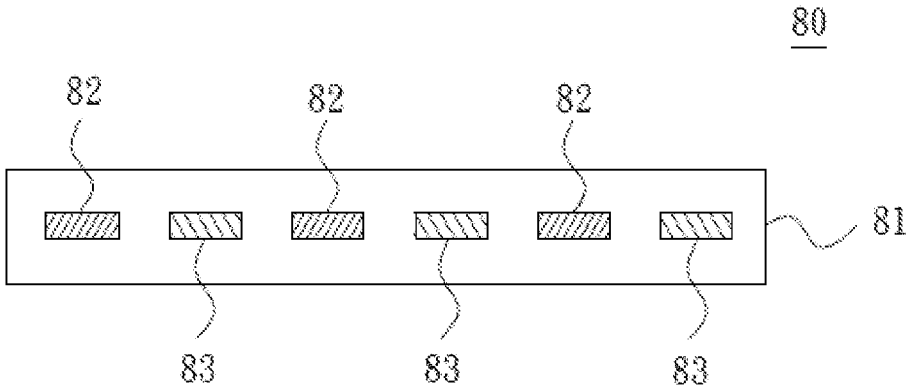
Fig. 2 Prior Art
FIG. 2 is a front view showing a structure of another currently existing LED light bar.
Figure 3:
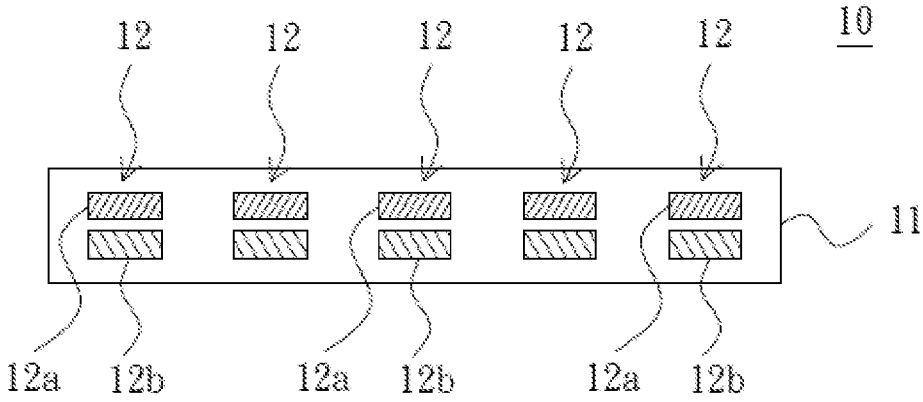
FIG. 3 is a front view of the light emitting diode (LED) light bar structure according to the first embodiment of the present invention.

Referring now to FIG. 3, a front view of the light emitting diode (LED) light bar structure according to the first embodiment of the present invention is illustrated in FIG. 3. An LED light bar structure 10 according to a first embodiment of the present invention comprises a circuit board 11 and a plurality of the light source sets 12, wherein the light source sets 12 are arranged on the circuit board 11. The LED light bar structure 10 is disposed at a side edge of a light guide plate (not shown), and emits lights toward the light guide plate.

As shown in FIG. 3, each of the light source sets 12 comprises a first LED 12*a* and a second LED 12*b*. Preferably, the first LED 12*a* and the second LED 12*b* are adjoined with an up-down arrangement in each of the light source sets 12, or the first LED 12*a* and the second LED 12*b* are adjoined with a left-right arrangement in each of the light source sets 12 (not shown). The key point is that: in each of the light source sets 12, the chromaticity of the first LED 12*a* and the chromaticity of the second LED 12*b* are complementary.

Figure 4:
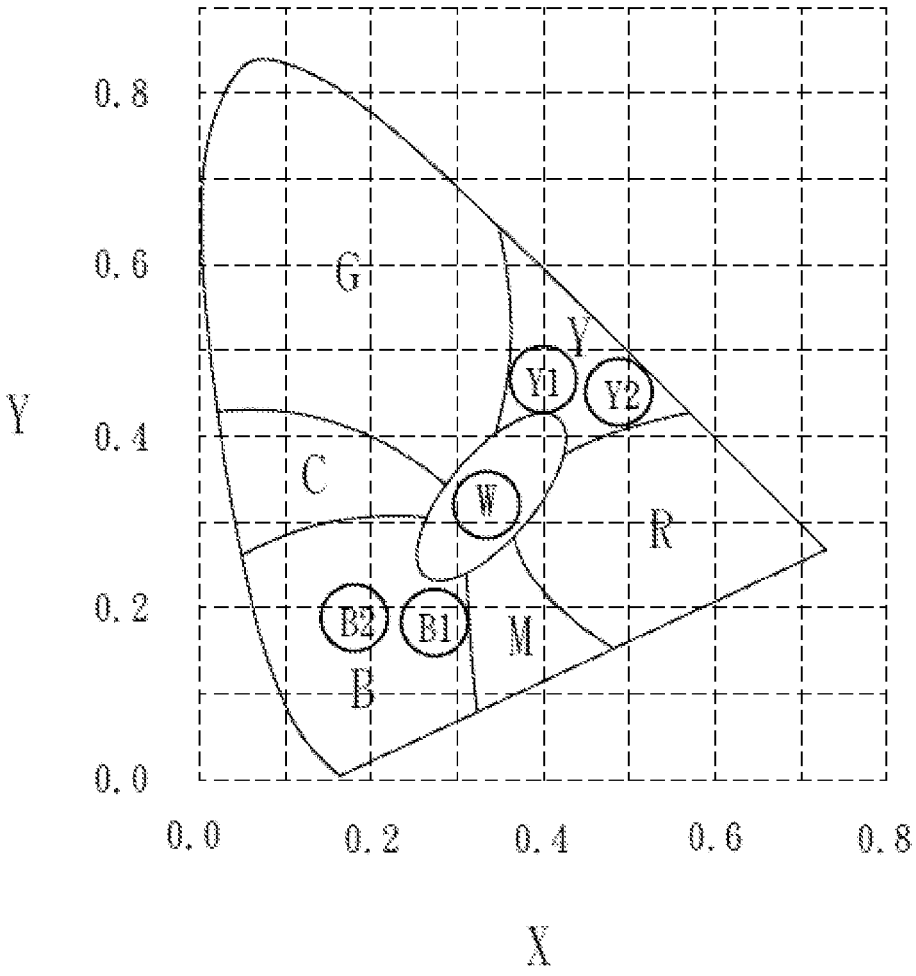
FIG. 4 is a schematic view showing an LED light bar structure of the present invention selects chromaticities from a CIE coordinate.

Referring to FIG. 4, a schematic view showing an LED light bar structure of the present invention selects chromaticities from a CIE coordinate is illustrated in FIG. 4. The CIE coordinate is generally used in this field, so it is used as an explanation for the present invention selecting LEDs with chromaticities of complementary colors. In the FIG. 4, there are various kinds of color areas, it mainly comprises the primary colors of lights: areas of R(red) light, G(green) light and B (blue) light. Furthermore, a near Y (yellow) light area is between the red light and green light; a near C (cyan) light area is between the green light and blue light; a near M (magenta) light area is between the blue light and red light; a W (white) light area is between the lights of R, G, B. A white light LED hopes to get the chromaticity in the white light area.

Referring to the FIGS. 3 and 4, for the white light area, a near blue light area B1 is symmetrical to the near yellow light area Y1, i.e. they are complementary colors to each other. Hence, if the chromaticity of the first LED 12*a* is in B1 and the chromaticity of the second LED 12*b* is in Y1, it can be mixed as a white light therebetween.

Moreover, for the white light area, a near blue light area B2 is symmetrical to the near yellow light area Y2, i.e. they are complementary colors to each other. Hence, if the chromaticity of the first LED 12*a* is in B2 and the chromaticity of the second LED 12*b* is in Y2, it can be mixed as a white light therebetween.

In addition, in the LED light bar structure 10 according to the first preferred embodiment of the present invention, each of the single light source sets 12 can select a couple of the chromaticities of the first LED 12*a* and the second LED 12*b* to mix the needed white light. In another word, each of the single light source sets 12 is not necessary to consider with the others of the light source sets 12, so it only selects two complementary colors from the CIE coordinate to mix the white light. Therefore, the entire LED light bar construct can achieve mixing as a uniform white light, and the backlight module will not appear the phenomenon of "Mura". Besides, the material of the LED will not be wasted, and it is easy to control the identical chromaticity between the different backlight modules.

The specific value of the chromaticity of the first LED 12*a* and the chromaticity of the second LED 12*b* are not limited in the present invention. Any couples of the complementary colors which can mix the white light are applied to the present invention.

Furthermore, the types of the LED 12*a*, 12*b* are not limited in the present invention. The LED 12*a*,12*b* can be follows: using blue LED to activate a yellow fluorescent body; using ultraviolet LED to activate a RGB (red, green, blue) fluorescent body; or using red, green and blue LED to achieve a white by adjust the brightness thereof, respectively.

Figure 5:
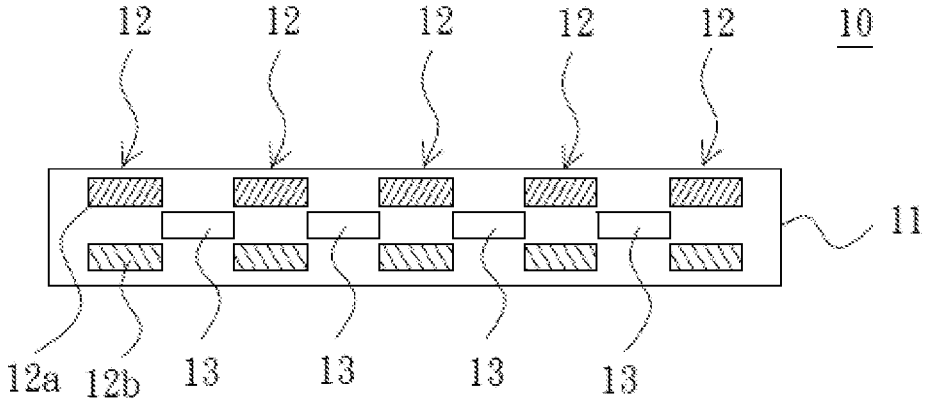
FIG. 5 is a front view of an LED light bar structure according to the second embodiment of the present invention.

Referring to FIG. 5, a front view of an LED light bar structure according to the second embodiment of the present invention is illustrated in FIG. 5. An LED light bar construct 10 according to the second preferred embodiment of the present invention is substantially similar to the he LED light bar construct 10 according to the first preferred embodiment of the present invention, so as to use similar terms and numerals, but the difference therebetween is that: in this embodiment, a third LED 13 is further inserted and composed between the light source sets 12, and the chromaticity of the LED 13 is in the white light area of the CIE coordinate. Preferably, the level height of the third LED 13 is between the first LED 12*a* and the second LED 12*b*. By the arrangement of the third LED 13 between the light source sets 12, it can further increase the flexibility of selection and arrangement of the LEDs. Moreover, if the present big size liquid crystal panel adopts the backlight module of edge lighting, the intensity of the LED light bar can not always satisfy the emitting intensity requirement. Hence, in the second embodiment of the present invention, by enhancing the emitting intensity, the LED light bar structure 10 according to the second preferred embodiment of the present invention can suit the backlight requirement of the big size liquid crystal panel.

As described above, in the traditional LCD module, the LED light bar is easy to appear the "Mura" phenomenon, and for uniform of the mixed white light of the LED light bar, the material selection of the LEDs is too exacting, so that it causes a waste of the material, and it is difficult to control the identical chromaticity between the different backlight modules. In the present invention, an LED light bar structure 10 is provided with a plurality of light source sets 12, wherein each of the light source sets 12 comprises a first LED 12*a* and a second LED 12*b*, and the chromaticity of the first LED 12*a* and the chromaticity of the second LED 12*b* is complementary. Hence, it is not necessary to consider with the others of the light source sets 12, so that it can achieve mixing the uniform white light, and the backlight module will not appear the phenomenon of "Mura". Besides, the material of the LED will not be wasted, and it is easy to control the identical chromaticity between the different backlight modules.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. A light emitting diode (LED) light bar structure of an LCD backlight module, comprising:

a circuit board; and a plurality of light source sets arranged on the circuit board in a row along a length-direction of the circuit board, wherein each of the light source sets comprises a first LED and a second LED; and the chromaticity of the first LED and the chromaticity of the second LED are complementary; wherein the first LED and the second LED are adjoined with an up-down arrangement along a width-direction of the circuit board in each of the light source sets; and a third LED is further inserted between two of the adjacent light source sets.

2. The LED light bar structure according to claim 1, wherein the chromaticity of the third LED is in the white light area of the CIE coordinate.

3. The LED light bar structure according to claim 1, wherein the position of the third LED is between the first LED and the second LED in the width-direction of the circuit board, and is offset from the light source sets in the length-direction of the circuit board.

4. An LED light bar structure of an LCD backlight module, comprising:

a circuit board; and a plurality of light source sets arranged on the circuit board in a row along a length-direction of the circuit board, wherein each of the light source sets comprises a first LED and a second LED; and the chromaticity of the first LED and the chromaticity of the second LED are complementary;

wherein the first LED and the second LED are adjoined with an up-down arrangement along a width-direction of the circuit board in each of the light source sets.

5. The LED light bar structure according to claim 4, wherein the chromaticity of the first LED is near blue in the CIE coordinate, and the chromaticity of the second LED is near yellow in the CIE coordinate.

6. The LED light bar structure according to claim 4, wherein a third LED is further inserted between two of the adjacent light source sets.

7. The LED light bar structure according to claim 6, wherein the chromaticity of the third LED is in the white light area of the CIE coordinate.

8. The LED light bar structure according to claim 4, wherein the position of the third LED is between the first LED and the second LED in the width-direction of the circuit board, and is offset from the light source sets in the length-direction of the circuit board.

9. An LCD backlight module, comprising:

a light guide plate; and an LED light bar structure disposed at a side edge of a light guide plate and emitting lights toward the light guide plate, wherein the LED light bar structure comprises:

a circuit board; and a plurality of light source sets arranged on the circuit board in a row along a length-direction of the circuit board, wherein each of the light source sets comprises a first LED and a second LED; and the chromaticity of the first LED and the chromaticity of the second LED are complementary;

wherein the first LED and the second LED are adjoined with an up-down arrangement along a width-direction of the circuit board in each of the light source sets.

10. The backlight module according to claim 9, wherein the chromaticity of the first LED is near blue in the CIE coordinate, and the chromaticity of the second LED is near yellow in the CIE coordinate.

11. The backlight module according to claim 9, wherein a third LED is further inserted between two of the light adjacent source sets.

12. The backlight module according to claim 11, wherein the chromaticity of the third LED is in the white light area of the CIE coordinate.

13. The backlight module according to claim 11, wherein the position of the third LED is between the first LED and the second LED in the width-direction of the circuit board, and is offset from the light source sets in the length-direction of the circuit board.

* * * * *